United States Patent [19]

Agostino

[11] Patent Number: 4,829,605

[45] Date of Patent: May 16, 1989

[54] DUAL FLUSH VALVE ASSEMBLY

[76] Inventor: Michael Agostino, 101-A Spring St., St. Augustine, Fla. 32084

[21] Appl. No.: 30,369

[22] Filed: Mar. 26, 1987

Related U.S. Application Data

[63] Continuation-in-part of Ser. No. 872,112, Oct. 31, 1986, abandoned, which is a continuation-in-part of Ser. No. 743,521, Jun. 11, 1985, abandoned.

[51] Int. Cl.[4] ..... E03D 3/12

[52] U.S. Cl. ..... 4/326

[58] Field of Search ..... 4/324–327

[56] References Cited

U.S. PATENT DOCUMENTS

| | | | |
|---|---|---|---|
| 1,474,288 | 11/1923 | Rath . | |
| 1,767,043 | 6/1930 | Blaun et al. . | |
| 1,960,864 | 5/1934 | Brown . | |
| 2,237,294 | 4/1941 | Easley . | |
| 2,598,967 | 6/1952 | Bennett . | |
| 2,731,647 | 1/1956 | Groth et al. . | |
| 2,839,759 | 6/1958 | Martino . | |
| 2,864,095 | 12/1958 | Martino . | |
| 2,940,084 | 6/1960 | Fabbi et al. . | |
| 3,768,103 | 10/1973 | Robinson . | |
| 3,909,856 | 10/1975 | Dunn . | |
| 3,913,149 | 10/1975 | Briton . | |
| 4,003,097 | 1/1977 | Book . | |
| 4,011,604 | 3/1977 | Goldsworthy . | |
| 4,096,591 | 6/1978 | Awis | 4/326 |
| 4,110,850 | 9/1978 | Tedei . | |
| 4,122,564 | 10/1978 | Addicks | 4/326 |
| 4,135,262 | 1/1979 | Overbey . | |
| 4,141,092 | 2/1979 | Jones | 4/324 |
| 4,172,299 | 10/1979 | del Pozo | 4/326 |
| 4,173,801 | 11/1979 | Bresnyan | 4/326 |
| 4,353,138 | 10/1982 | Bell | 4/326 |
| 4,504,984 | 3/1985 | Burns | 4/326 |

*Primary Examiner*—Charles E. Phillips
*Attorney, Agent, or Firm*—Arthur G. Yeager

[57] ABSTRACT

A dual flush valve assembly for a toilet tank including an overflow pipe, a pair of spaced inlets communicating with the pipe, a pair of flap valves selectively closing the inlets, a pair of spaced handles connected to respective valve operating rods controlling the flap valves, a fitting disposed in an opening in a front of a tank mounting the handles thereto in substantially the same vertical plane one above the other, and two spaced pairs of shoulders extending outwardly from the fitting with the handles being movable between a respective spaced pair of shoulders to limit the movement thereof. The flap valves have a wedge shaped body and are reversible for increased life thereof. The pipe and pair of inlets are removably mounted to a drain extending within the tank from the toilet basin without removal of the drain pipe. The overflow pipe may be aligned with the drain pipe with the inlets being offset therefrom, or one drain pipe and full flush inlet may be offset with the partial flush inlet being aligned with the drain pipe.

24 Claims, 2 Drawing Sheets

DUAL FLUSH VALVE ASSEMBLY

CROSS REFERENCE TO RELATED APPLICATIONS

This application is a continuation-in-part of U.S. Pat. Application Ser. No. 872,112, filed Oct. 31, 1986, entitled A Dual Flush Valve System, which was a continuation-in-part of U.S. Pat. Application Ser. No. 743,521, filed June 11, 1985, both now abandoned.

BACKGROUND OF THE INVENTION

This invention relates to a new and improved flush valve assembly usable in a conventional water tank of a toilet to provide a partial or approximately one-half flush and full flush selectability.

The need for conservation of water becomes more critical with the passage of time and greater number of inhabitants on earth. It is well recognized that approximately one-half flush is all that is needed to dispose of liquid wastes and full flushing of solid wastes in conventional toilet bowls.

There are a number of prior art systems that selectively partially flush or fully flush conventional toilets; namely, those shown and described in the following U.S. Pat. Nos.

| | | | |
|---|---|---|---|
| 1,474,288 | Rath | 4,042,982 | Contreras |
| 1,767,043 | Blaun et al | 4,011,604 | Goldsworthy |
| 1,960,864 | Brown | 4,056,856 | Reid |
| 2,237,294 | Easley | 4,096,591 | Awis |
| 2,731,647 | Groth et al | 4,110,850 | Tedei |
| 2,839,759 | Martino | 4,122,564 | Addicks et al |
| 2,864,095 | Martino | 4,135,262 | Overbey |
| 2,940,084 | Fabbi et al | 4,141,092 | Jones |
| 3,768,103 | Robinson | 4,172,299 | del Pozo |
| 3,909,856 | Dunn | 4,173,801 | Bresnyan |
| 3,913,149 | Brinton | 4,353,138 | Bell |
| 4,003,097 | Book | 4,504,984 | Burns |

The systems shown in various of the above prior art have complex operating mechanisms, others are expensive in the manufacture thereof, others are not positive in the selection of partial or full flushes, some are difficult to install and/or service, and a few have a multiplicity of the above disadvantages as well as other shortcomings. Accordingly, the primary objective of this invention is to provide an improved dual flush valve assembly which alleviates or substantially overcomes some, if not all, of the disadvantages set forth hereabove.

Another object is the provision of separated handles which are aligned in a vertical plane with positive stops so that the user's hand can select and move each handle positively while substantiably eliminating inadvertent movement of the non-selected handle.

A further object is to provide for a unique fitting through the flush operating opening of conventional toilet tanks in which two vertically spaced pivot passageways are provided for accommodating respective unitary elongated operating rods therethrough, such fitting having a cover connected thereto and providing the stops for the respective handles at the outer free ends of such rods.

Other features include an ipproved dual drain pipe replaceable from within the toilet tank without removal or replacement of the connection between tank and bowl; and a dual flush flap valve operably connected to each of the passageways for partial and full flush communicating with such improved dual drain pipe and reversible for extended wear and life of such flap valves.

A further feature is the provision of an improved dual flush assembly which is commercially more acceptable by the user and which is reliable in construction and use

SUMMARY OF THE INVENTION

The flush valve assembly for a toilet tank according to this invention includes an upstanding pipe open at least at its lower end for communication with a toilet bowl, a first inlet communicating with such pipe at a level spacedly above its lower end, and a second inlet communicating with such pipe at a level adjacent its lower end. First valve means cooperates with the first inlet and means mount the first valve means for movement from a first position in which the first inlet is closed to a second position in which the first inlet is open. Second valve means cooperates with the second inlet and means mount the second valve means for movement from a first position in which the second inlet is closed to a second position in which the second inlet is open. First valve operating means connects the first valve means to a first actuating means operable to move the first valve means from its first position to its second position. Second valve operating means connects the second valve means to a second actuating means operable to move the second valve means from its first position to its second position. A means mounts both of the first and second actuating means to a front of a tank in substantially the same vertical plane and one above the other and spaced from and substantially parallel to a front wall of a toilet tank. Another means is provided to form a stop for one of the actuating means to inhibit unintended movement of the other actuating means when moving the one actuating means.

In other aspects the means for providing a stop includes a fitting with spaced limit shoulders extending outwardly from the fitting, and each of the first and second actuating means includes a portion selectively engageable with respective spaced limit shoulders to limit the movement of each such portion. Each of the first and second valve means is defined by a flap valve, and each of the means mounting respective first and second flap valves includes a pivot means attached to the upstanding pipe. Each flap valve is formed with an elongated base and identical outwardly extending and closed protuberances which are oppositely disposed on the base with one protuberance being disposed within one inlet when the flap valve is in its first position, and each flap valve is made to be buoyant. Each protuberance includes selective means for attachment thereto of one of valve operating means, and the selective means includes a tab and an opening extending therethrough for connection of one of the valve operating means.

Further aspects of the invention are seen wherein the upstanding pipe has an elongated vertical overflow pipe with an upper end located below an upper end of a toilet tank and below the location on a toilet tank of the means mounting the first and second actuating means. The first and second inlets each communicate with the overflow pipe, and the overflow pipe is smaller in diameter than the first and second inlets. The upstanding pipe's lower end is internally threaded and sealingly connected to an outwardly threaded pipe secured to and extending through a bottom of a toilet tank. The overflow ppipe is substantially aligned with the lower end of the upstanding pipe, in one embodiment, and such upstanding pipe includes a pair of generally oppositely extending drain pipes communicating with the overflow pipe and carrying respective first and second inlets. In another embodiment the overflow pipe is offset from the lower end of the upstanding pipe and such upstanding pipe has a laterally extending drain pipe carrying the second inlet. The first inlet in this embodiment is in alignment with the lower end of the upstanding pipe.

Further aspects relate to the means mounting the first and second actuating means which includes a fitting disposable through an opening in a front of a water tank. Each of the first and second actuating means has a pivot portion extending through and pivoted within the fitting and each pivot portion is spaced and substantially vertically aligned. The upper of pivot portion is connected to the first actuating means and the lower pivot portion is connected to the second actuating means. The first and second actuating means includes spaced handles and the means for providing a stop includes two spaced pairs of shoulders extending outwardly from the fitting with the first and second handle being movable between a spaced pair of shoulders to limit the movement thereof, the first handle is disposed above the second handle and movable from a generally upwardly angular position to a generally horizontal position, and the second handle is movable from a generally horizontal position to a generally downwardly angular position therefrom.

A general object of this invention is to provide an improved dual flush valve assembly for toilet tanks.

A specific object is the provision of dual handles for individual selective flushing, particularly partial flushing, without inadvertent movement and flushing the full tank.

Another specific object is to provide a dual flush valve assembly which is easy to install and service by an unskilled person and one that is reliable in use and inexpensive in construction.

Further specific objects are the provision of improved flap valves for extended wear and use, and an upright overflow and dual inlets which may be serviced and removed from the toilet tank without removing the connection to the toilet tank.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE PREFERRED EMBODIMENT OF THE INVENTION

Figure 1:
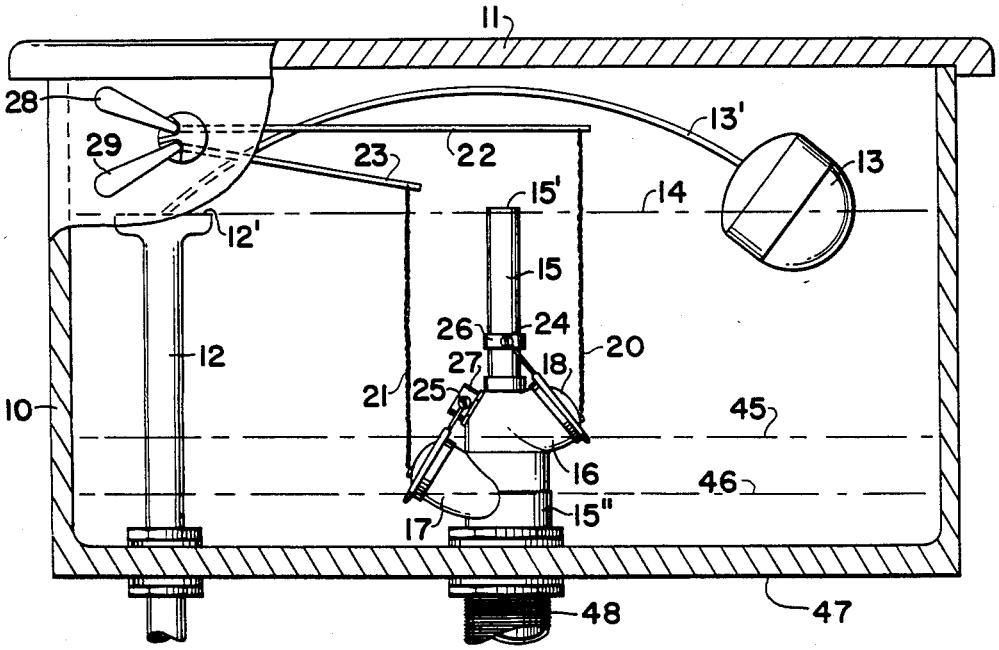
FIG. 1 is a front elevational view of a toilet tank for a toilet bowl with the dual flush valve assembly in accord with this invention installed therein, parts being broken away for clarity of illustration.

Referring now more particularly to the drawings, the flush valve assembly in accord with this invention is generally depicted in FIG. 1 which shows a common toilet tank 10 with a removable cover 11, an inlet water tube 12 passing through the bottom wall 47 of the tank 10, with a valve 12' at the top of the tube 12 operated by float 13 via elongated rod 13', all as well known in the art. When the float 13 is in its uppermost position on the upper or full level 14 of water in tank 10, the valve 12' stops the flow of water via tube 12 into tank 10. Upon dropping of the water level from level 14 to a mid-level 45 or lower level 46 or intermediate positions below level 14, valve 12' opens to let water into tank 10 via tube 12. An elongated overflow pipe 15 extends from its upper end 15' above level 14 to its lower end 15'' which communicates with the outlet pipe 48 attached to the common toilet basin.

The above described components are found in the common flush type toilet tank. Of course, different water flow valves and inlet pipes are also common without a float, such as float 13. However, in accord with this invention, overflow pipe 15 communicates with a intermediate pipe first inlet 16 and a first selectively operable valve means 18 pivotally connected by pivot means 24 to a collar 26 attached to overflow pipe 15. Thus when valve 18 is lifted by upward movement of first actuating means, including chain 20 and rod 22, valve 18 moves from its first position in which the valve is closed to a second upward position in which the valve is open. After the level of the water moves through inlet 16 into the outlet pipe 48 to a level indicated generally by numeral 45, the valve 18 will close by gravity and the tank 10 will refill to level 14. The fore-going describes a partial flush of approximately one-half the water in tank 10 and can be used when only liquids are to be disposed through the drain of the toilet basin.

With regard to the full flush, i.e., when solids are to be flushed from the toilet basin, a second valve 19 covering a second inlet 17 adjacent the bottom 47 of tank 10 communicates with overflow 15 and outlet pipe 48, and upward movement of valve 19 from its first position in which the valve is closed to a second upward position in which the valve is open causes a full flush of the toilet basin down to the lower level 46 whereupon the valve 19 closes by gravity. Similar to chain 20 and rod 22 operating valve 18, chain 21 and rod 23 move valve 19 upwardly on a pivot means 25 supported by collar 27.

As seen in FIG. 1, the overflow pipe 15 is in general vertical alignment with the outlet pipe 48 and inlets 16 and 17 are laterally disposed on opposite sides of pipe 15 with one of the inlets 16 and 17 adjacent inlet pipe 12 and the other of the inlets 16 and 17 being remote therefrom.

Figure 2:
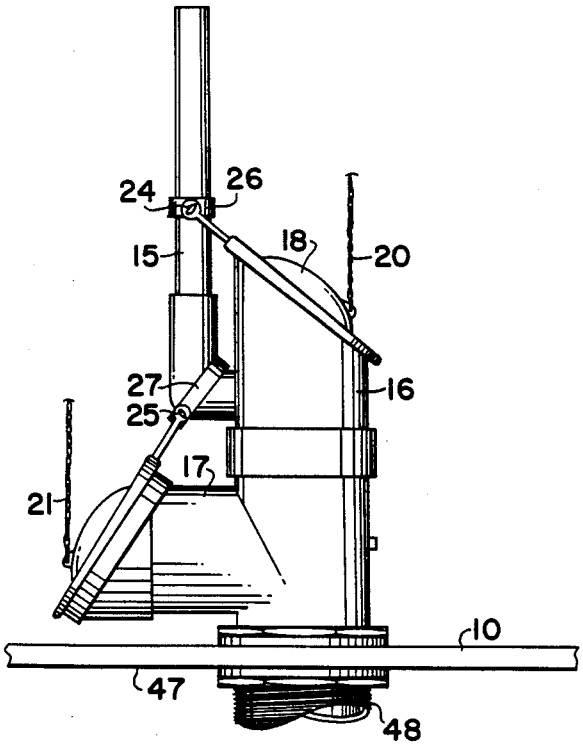
FIG. 2 is an enlarged front elevational view similar to part of FIG. 1 and showing another embodiment in accord with this invention.

As seen in FIG. 1, the overflow pipe 15 is in general vertical alignment with the outlet pipe 48 and inlets 16 and 17 are laterally disposed on opposite sides of pipe 15 with one of the inlets 16 and 17 adjacent inlet pipe 12 and the other of the inlets 16 and 17 being remote therefrom. Another embodiment is depicted in FIG. 2, with the partial flush inlet 16 being in alignment with drain outlet pipe 48 with overflow pipe 15 being offset toward inlet pipe 12 (as seen in FIG. 1) and inlet 17 being the same a hereinabove described in connection with FIG. 1.

Figure 3:
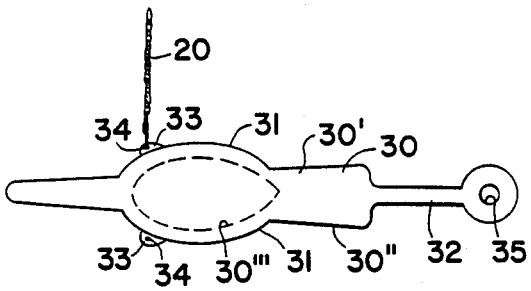
FIG. 3 is an enlarged side elevational view of a flap valve in accord with this invention.
Figure 4:
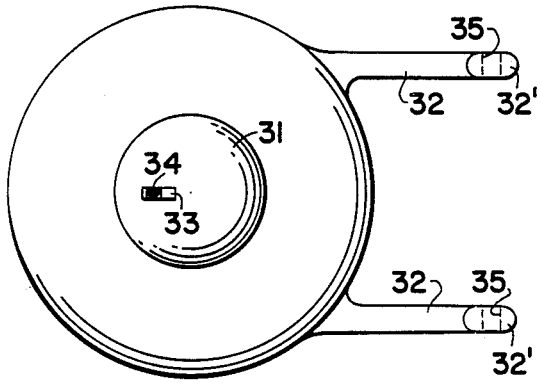
FIG. 4 is a top plan view of the flap valve of FIG. 3.

Before describing the details of the first actuating means, including handle 28 connected to selectively move rod 22 and second actuating means, including handle 29 connected to rod 23, attention is directed to FIGS. 3 and 4 in which either flap valve 18 or 19 are depicted by a rubber or soft plastic base member, preferably in the general form of a wedge, having mirrored upper and lower surfaces 30' and 30'' having a hollow 30''' between two oppositely disposed generally spherical segments 31. A pair of spaced pivot arms have terminal end portions 32' through which aligned passageways 35 extend for receiving the pivot means 24 or 25 therethrough depending on whether the flap valve is mounted as the upper or lower valve elements 18 or 19. Extending vertically from segments 31, are tabs 33 through which are respective lateral holes 34 into which are hooked chain 20 or 21 as seen in FIG. 1. A specific advantage is obtained by making the flap valves 18 and 19 in accord with FIGS. 3 and 4 in that normally such valves may be usefully employed for twice the length of time as normal flap valves in that the homeowner merely removes the arms 32 from the pivot engagements and the chain from opening 33 in the position of FIG. 3, for example, flips it upside down and reconnects te pivots and chain.

Figure 5:
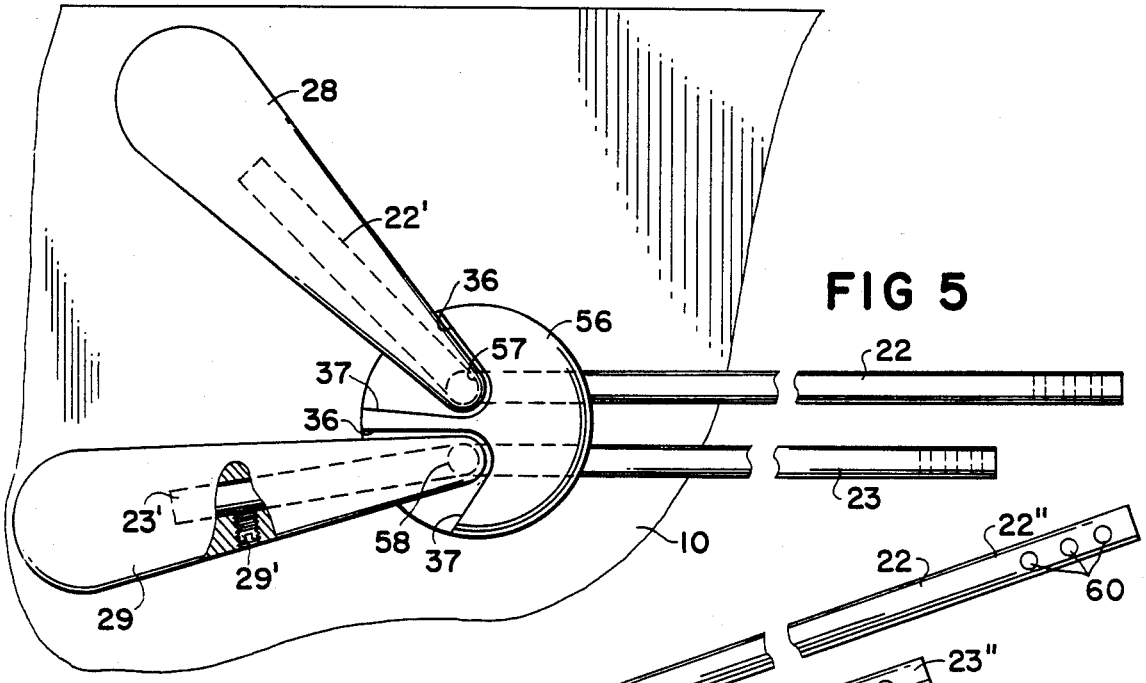
FIG. 5 is an enlarged front elevational view of the outer handles, the through fitting and inner rods depicted in FIG. 1.
Figure 6:
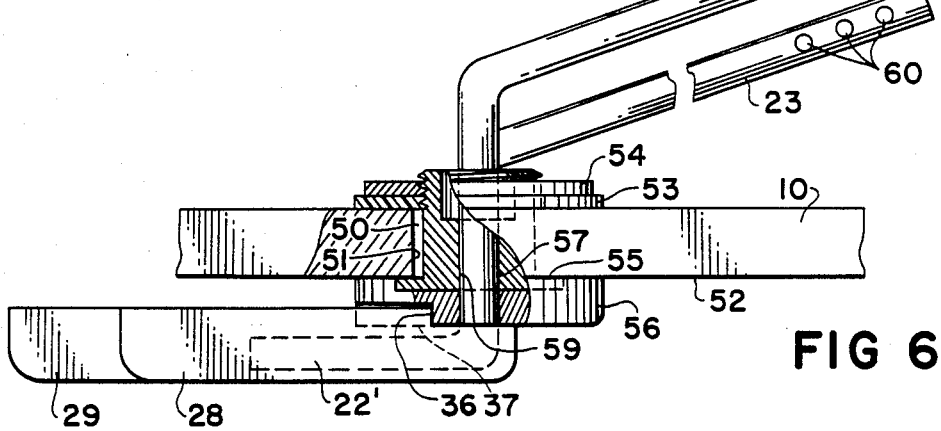
FIG. 6 is a top plan view of FIG. 5 partly broken away for clarity of assembly of parts.

In accord with this invention, the first and second actuating means, in the form of handles 28 and 29, are shown in FIGS. 1, 5 and 6, and are respectively connected to the outer ends 22' and 23' of rods 22 and 23, by set screws, including set screw 29', or the rod ends may be threaded with mating threads on the handles, or otherwise affixed. A threaded plug 50 extends through an opening 51 in the front wall 52 of the toilet tank 10 with a suitable seal 53 and nut 54 threaded onto plug 50 inwardly of wall 22. By tightening nut 54, the outer flange 55 carrying cover 56 is forcibly brought into contact with the wall 52 and maintained in proper nonrotatable position onto front wall 52. Cover 56 may be affixed by a set screw, similar to set screws 29' from its lower surface into engagement with flange 55 or any other appropriate ways of connecting cover 56 to flange 55 may be employed. As seen in FIG. 5, cover 56 includes spaced shoulder means 36 and 37 for each of handles 28 and 29, shoulder means 36 limiting the upward movement to the proper flushing positions of handles 28 and 29 and shoulder means 37 limiting the downward movement to the proper flushed positions of handles 28 and 29. As may be seen from FIGS. 5 and 6, the handles 28 and 29 are preferably in the same vertical plane with limits or stops so that the user cannot inadvertently begin flushing, for example, by depressing handle 28 and continue movement hereof to engage handle 29 to cause a full flush inadvertently. This problem is believed to be apparent when considering some of the prior art, including Robinson, U.S. Pat. No. 3,768,103 with the dual handles for flushing being aligned horizontally and without any limits or stops to inhibit simultaneous movement of both handles.

Rods 22 and 23 are preferably round, but in any event, the pivot portions 57 and 58 of rods 22 and 23, are round and journalled in respective plug passageways, including passageway 59, such passageways being vertically aligned as would be apparent from considering FIG. 5, with pivot portions 57 and 58 being shown in broken lines. While the handles 28, 29, rods 22 and 23, plug 50, and cover 56 may be separate components to be installed by a user or a plumber, preferably these components are fabricated and assembled as a unit so that the installer would merely snake the free ends 22'' and 23', containing a plurality of spaced openings 60 for connection to respective chains 20 and 21, through opening 51 in front wall 52 of tank 10 from the outside until the plug is located within the opening 51, then the seal or gasket 53 and nut 54 are fed onto the free ends 22'' and 23'' and positioned about the threads of plug 50 and nut 54 is then tightened to secure the plug 50, cover 56 and handles 28 and 29 in their appropriate locations. Of course, minor rotative adjustments of the plug 50 and cover 56 can be made to make certain that the upper handle 28 does not engage the toilet tank cover 11, for example, and the rods 22 and 23 can be appropriately bent if necessary, within the tank 10 preferably to vertically align one opening 60 on each rod 22 and 23 above its attachment via chains 20 and 21 to respective flap valves 18 and 19.

Figure 7:
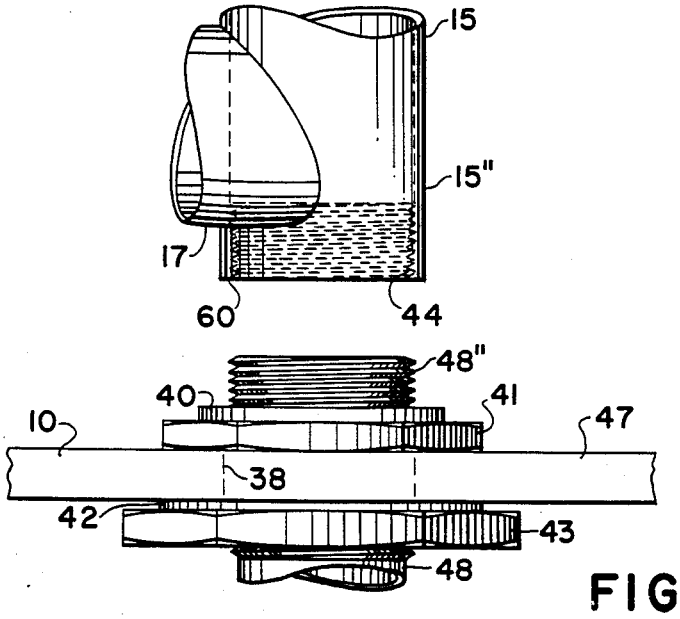
FIG. 7 is an enlarged and exploded front elevational view, partly in section, of the drain tube lower end connection to a bottom of a toilet tank.

In FIG. 7 the connection of the pipe end 15'' of pipe 15 (or pipe 16 from FIG. 2) includes an internally threaded portion 44 mating with external threads 48' of pipe 48 which extends from the toilet basin through an opening 38 in the bottom wall 47 of toilet tank 10. Preferably pipe 48 is sealed below wall 47 by gasket 42 and threaded nut 43 and affixed above wall 47 inside tank 10 by another nut 41 threaded onto threads 48'. Another gasket or seal 40 surrounds pipe 48 and the end 60 of pipe 15 engages seal 40 upon tightening of pipe 15 down on threads 48'. Therefore, if an inlet 17 or 16 cracks or there is any other reason that the unit comprising pipes and inlets 15, 16 an 17 requires replacement, the same can be easily accomplished within the tank 10 without the necessity of removing the tank and seal connection of outlet drain pipe 48 from its connection to the toilet tank 10 and/or the toilet basin.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A toilet tank flush valve assembly comprising a straight, upstanding pipe open at least at its lower end for communication with a toilet bowl, a first inlet in communication with said pipe at a level spacedly above its lower end; a second inlet in communication with said pipe at a level adjacent its lower end; first valve means; means mounting said first valve means for movement from a first position in which said first inlet is closed to a second position in which said first inlet is open; second valve means; means mounting said second valve means for movement from a first position in which said second inlet is closed to a second position in which said second inlet is open; first valve operating means connected to said first valve means; first actuating means connected to said first valve operation means and operable to move said first valve means from its first position to its second position; second valve operating means connected to said second valve means, second actuating means independent of said first actuating means connected to said second valve operating means and operable to move said second valve means from its first position to its second position, means mounting said first and second actuating means for independent movement thereof to a front of a tank in substantially the same vertical plane, one above the other and spaced from and substantially parallel to a front wall of a toilet tank, and means for providing a stop for said one actuating means to inhibit unintended movement of said other actuating means by said one actuating means when moving said one actuating means.

2. The assembly of claim 1 wherein sadd means for providing a stop includes spaced limit shoulders extending outwardly from a toilet tank, each of said first and second actuating means having a portion selectively engageable with respective said spaced limit shoulders to limit the movement of each said portion.

3. The assembly of claim 1 wherein each of said first and second valve means includes a flap valve, each of said means mounting respective said first and second flap valves includes a pivot means attached to said upstanding pipe.

4. The assembly of claim 3 wherein each said flap vllve includes an elongated base and identical outwardly extending and closed protuberances which are oppositely disposed on said base with one said protuberance being disposed within one said inlet when said flap valve is in its said first position, each said flap valve having a buoyant body.

5. The assembly of claim 3 wherein each said protuberance includes selective means for attachment thereto of one of said valve operating means, said selective means including a tab and an opening extending therethrough for connection of one of said valve operating means.

6. The assembly of claim 1 wherein said upstanding pipe includes an elongated vertical overflow pipe having an upper end located below an upper end of a toilet tank and below the location on a toilet tank of said means mounting said first and second actuating means, said first and second inlets each communicating with said overflow pipe, said overflow pipe being smaller in diameter than said first and second inlets, said upstanding pipe's lower end being threadedly connected to an outwardly threaded pipe secured to and extending through a bottom of a toilet tank.

7. The assembly of claim 6 wherein said overflow pipe is substantially aligned with said lower end of said upstanding pipe, said upstanding pipe including a pair of generally oppositely extending drain pipes communicating with said overflow pipe and carrying respective said first and second inlets.

8. The assembly of claim 6 wherein said overflow pipe is offset from said lower end of said upstanding pipe, said upstanding pipe having a laterally extending drain pipe carrying said second inlet, said first inlet being in alignment with said lower end of said upstanding pipe.

9. The assembly of claim 1 wherein said means mounting said first and second actuating means includes a fitting disposable through an opening in a front of a water tank, each of said first and second actuating means including a pivot portion extending through and pivoted within said fitting, each said pivot portion being spaced and substantially vertically aligned, the upper of said pivot portion being connected to said first actuating means and the lower of said pivot portion being connected to said second actuating means.

10. The assembly of claim 9 wherein said means for providing a stop includes spaced limit shoulders extending outwardly from said fitting, each of said first and second actuating means having a portion selectively engageable with respective said spaced limit shoulders to limit the movement of each said portion.

11. A dual flush valve assembly for a toilet tank comprising an upstanding pipe means open at least at its lower end communicating with a toilet bowl, a first inlet communicating with said pipe means at a level spacedly above said lower end, a second inlet communicating with said pipe means at a level adjacent said lower end, first valve means cooperating with said first inlet, first means mounting said first valve means for movement from a first position in which said first inlet is closed to a second position in which said first inlet is open, second valve means cooperating with said second inlet, second means mounting said second valve means for movement from a first position in which said second inlet is closed to a second position in which said second inlet is open, first valve operating means connected to said first valve means, first actuating means connected to said first valve operating means and operable to move said first valve means from its said first position to its said second position, second valve operating means connected to said second valve means, second actuating means independent of said first actuating means connected to said second valve operating means and operable to move said second valve means from its said first position to its said second position, means mounting said first and second actuating means for independent movement thereof to a front of a toilet tank in substantially the same vertical plane one above the other and spaced from and substantially parallel to a front wall of a toilet tank and stop means for limiting said first actuating means to inhibit unintended movement of said second actuating means by said first actuating means when moving said first actuating means.

12. The assembly of claim 11 wherein each of said first and second valve means includes a flap valve, each of said first and second means mounting respective said first and second flap valves includes a pivot means attached to said upstanding pipe means.

13. The assembly of claim 12 wherein each said flap valve includes an elongated base and identical outwardly extending and closed protuberances which are oppositely disposed on said base with one said protuberance being disposed within one said inlet when said flap valve is in its said first position.

14. The assembly of claim 12 wherein each said flap valve includes a buoyant body.

15. The assembly of claim 12 wherein each said protuberance includes selective means for attachment thereto of one of said valve operating means.

16. The assembly of claim 15 wherein said selective means includes a tab and an opening extending therethrough for connection of one of said valve operating means.

17. The assembly of claim 11 wherein said upstanding pipe means includes an elongated vertical overflow pipe having an upper end located below an upper end of a toilet tank and below the location on a toilet tank of said means mounting said first and second actuating means, said first and second inlets each communicating with said overflow pipe, said overflow pipe being smaller in diameter than said first and second inlets, said pipe means lower end being threadedly connected to an outwardly threaded pipe secured to and extending through a bottom of a toilet tank.

18. The assembly of claim 17 wherein said overflow pipe is substantially aligned with said lower end, said pipe means including a pair of generally oppositely extending drain pipes communicating with said overflow pipe and carrying respective said first and second inlets.

19. The assembly of claim 17 wherein said overflow pipe is offset from said lower end, said pipe means having a laterally extending drain pipe carrying said second inlet, said first inlet being in alignment with said lower end.

20. The assembly of claim 19 wherein said first and second means mounting said first and second valve means are disposed on and supported by said overflow pipe.

21. The assembly of claim 11 wherein said means mounting said first and second actuating means includes a fitting disposable through an opening in a front of a water tank, each of said first and second actuating means including a pivot portion extending through and pivoted within said fitting, each said pivot portion being substantially vertically aligned.

22. The assembly of claim 21 wherein the upper of said pivot portion being connected to said first actuating means and the lower of said pivot portion being connected to said second actuating means.

23. The assembly of claim 11 wherein said stop means for limiting includes spaced limit shoulders, each of said first and second actuating means having a portion selectively engageable with respective said spaced limit shoulders to limit the movement of each said portion.

24. A toilet tank flush valve assembly comprising an upstanding pipe open at least at its lower end for communication with a toilet bowl, a first inlet communicating with said pipe at a level spacedly above its lower end, a second inlet in communication with said pipe at a level adjacent its lower end, a first flap valve, means mounting said first valve for movement from a first position in which said first inlet is closed to a second position in which said first inlet is open, a second flap valve means, means mounting said second valve for movement from a first position in which said second inlet is closed to a second position in which said second inlet is open, first valve operating means connected to said first valve, a first handle connected to said first valve operating means and operable to actuate said first valve from its first position to its second posttion, second valve operating means connected to said second valve, a second handle connected to said second valve operating means and operable to actuate said second valve from its first position to its second position, a fitting disposed in an opening in a front of a tank for mounting said first and second handles outwardly of a front of a tank in substantially the same vertical plane one above the other and spaced from and substantially parallel to a front wall of a tank, and two spaced pairs of shoulders extending outwardly from said fitting with said first and second handle being independently movable between a respective said spaced pair of shoulders to limit the movement thereof, said first handle being disposed above said second handle and being movable from a generally upwardly angular position to a generally horizontal position, said second handle being movable from a generally horizontal position to a generally downwardly angular position therefrom.

* * * * *